US007207843B1

(12) United States Patent
Chang

(10) Patent No.: US 7,207,843 B1
(45) Date of Patent: Apr. 24, 2007

(54) SPARK LEAKAGE SHUTOFF PROTECTIVE DEVICE FOR PLUG

(76) Inventor: Hung-Lin Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 11/408,869

(22) Filed: Apr. 24, 2006

(51) Int. Cl.
*H01R 33/945* (2006.01)

(52) U.S. Cl. ..... 439/620.01; 439/181

(58) Field of Classification Search ..... 439/180–188, 439/620.01, 660; 200/51 R, 51.01
See application file for complete search history.

(56) References Cited

U.S. PATENT DOCUMENTS 4,118,098 A * 10/1978 Swift ..... 439/620.01
4,820,203 A * 4/1989 Figone ..... 439/620.01
6,746,258 B2 * 6/2004 Kikuchi et al. ..... 439/181
6,758,690 B1 * 7/2004 Yu et al. ..... 439/140
6,762,376 B2 * 7/2004 Nakamura et al. ..... 200/60
6,942,503 B2 * 9/2005 Yamaguchi et al. ..... 439/141
6,942,509 B2 * 9/2005 Sasame et al. ..... 439/181

* cited by examiner

*Primary Examiner*—Khiem Nguyen
(74) *Attorney, Agent, or Firm*—Alan D. Kamrath; Nikolai & Mersereau, P.A.

(57) ABSTRACT

A spark leakage shutoff protective device for a plug includes an upright snapping lever, a leakage detection electromagnetic valve, a restoring member, and an upright support wall. The snapping lever is located between the restoring member and the leakage detection electromagnetic valve. Thus, the snapping lever is hidden in the restoring member to reduce the volume of the spark leakage shutoff protective device so that the spark leakage shutoff protective device occupies a smaller space in the plug. In addition, the snapping lever is supported by the support wall, so that the snapping lever is not easily deformed or worn out during a long-term utilization, thereby enhancing the lifetime of the snapping lever.

12 Claims, 5 Drawing Sheets

SPARK LEAKAGE SHUTOFF PROTECTIVE DEVICE FOR PLUG

BACKGROUND OF THE INVENTION

1. Field of the Invention

The present invention relates to a spark leakage shutoff protective device and, more particularly, to a spark leakage shutoff protective device for a plug.

2. Description of the Related Art

A spark leakage shutoff protective device is mounted in a plug to shut the electric power of the plug when spark leakage occurs so as to provide a protective effect to the plug. The plug has at least two legs.

A conventional spark leakage shutoff protective device 10 in accordance with the prior art shown in FIGS. 5–7 comprises an upright flexible snapping lever 14 mounted on the plug (not shown) and having a distal end formed with a snapping hook 140, a voltage detection electromagnetic valve 11 mounted on the plug, and a restoring member 12 having a first end detachably mounted on the snapping hook 140 of the snapping lever 14 and a second end driven by the voltage detection electromagnetic valve 11 to move the restoring member 12 so that the restoring member 12 is movable between a first position as shown in FIG. 6 where the first end of the restoring member 12 is snapped onto the snapping hook 140 of the snapping lever 14 and a second position as shown in FIG. 7 where the first end of the restoring member 12 is detached from the snapping hook 140 of the snapping lever 14. The snapping hook 140 of the snapping lever 14 has a tapered shape and is arranged from an outside toward an inside thereof. The restoring member 12 is located between the voltage detection electromagnetic valve 11 and the snapping lever 14.

In operation, when the voltage detection electromagnetic valve 11 detects that the spark leakage occurs, the second end of the restoring member 12 is driven by the voltage detection electromagnetic valve 11 to move the restoring member 12 so that the first end of the restoring member 12 is detached from the snapping hook 140 of the snapping lever 14 as shown in FIG. 7, to shut the electric power of the plug so as to provide a protective effect to the plug.

However, the snapping lever 14 is located outside of the restoring member 12 so that the snapping lever 14 is closer to the legs of the plug. Thus, the snapping lever 14 is easily deformed or worn out due to a higher temperature of the legs of the plug, thereby decreasing the lifetime of the snapping lever 14. In addition, the snapping lever 14 is subjected to a stress from the restoring member 12, and the stress is concentrated on the root portion of the snapping lever 14, so that the snapping lever 14 is easily deformed or worn out due to the stress concentration during a long-term utilization, thereby affecting operation of the snapping lever 14.

BRIEF SUMMARY OF THE INVENTION

In accordance with the present invention, there is provided a spark leakage shutoff protective device, comprising an upright flexible snapping lever having a distal end formed with a snapping hook, a leakage detection electromagnetic valve spaced from the snapping lever, and a restoring member having a first end detachably mounted on the snapping hook of the snapping lever and a second end driven by the leakage detection electromagnetic valve to move the restoring member. The snapping lever is located between the restoring member and the leakage detection electromagnetic valve.

The primary objective of the present invention is to provide a spark leakage shutoff protective device, wherein the snapping lever is hidden in the restoring member to reduce the volume of the spark leakage shutoff protective device so that the spark leakage shutoff protective device occupies a smaller space in the plug.

Another objective of the present invention is to provide a spark leakage shutoff protective device, wherein the snapping lever is supported by the support wall, so that the snapping lever is not easily deformed or worn out during a long-term utilization, thereby enhancing the lifetime of the snapping lever.

A further objective of the present invention is to provide a spark leakage shutoff protective device, wherein the snapping lever is hidden in the restoring member so that the snapping lever is spaced from the legs of the plug to prevent the snapping lever from being deformed or worn out due to a higher temperature of the legs of the plug, thereby enhancing the lifetime of the snapping lever.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
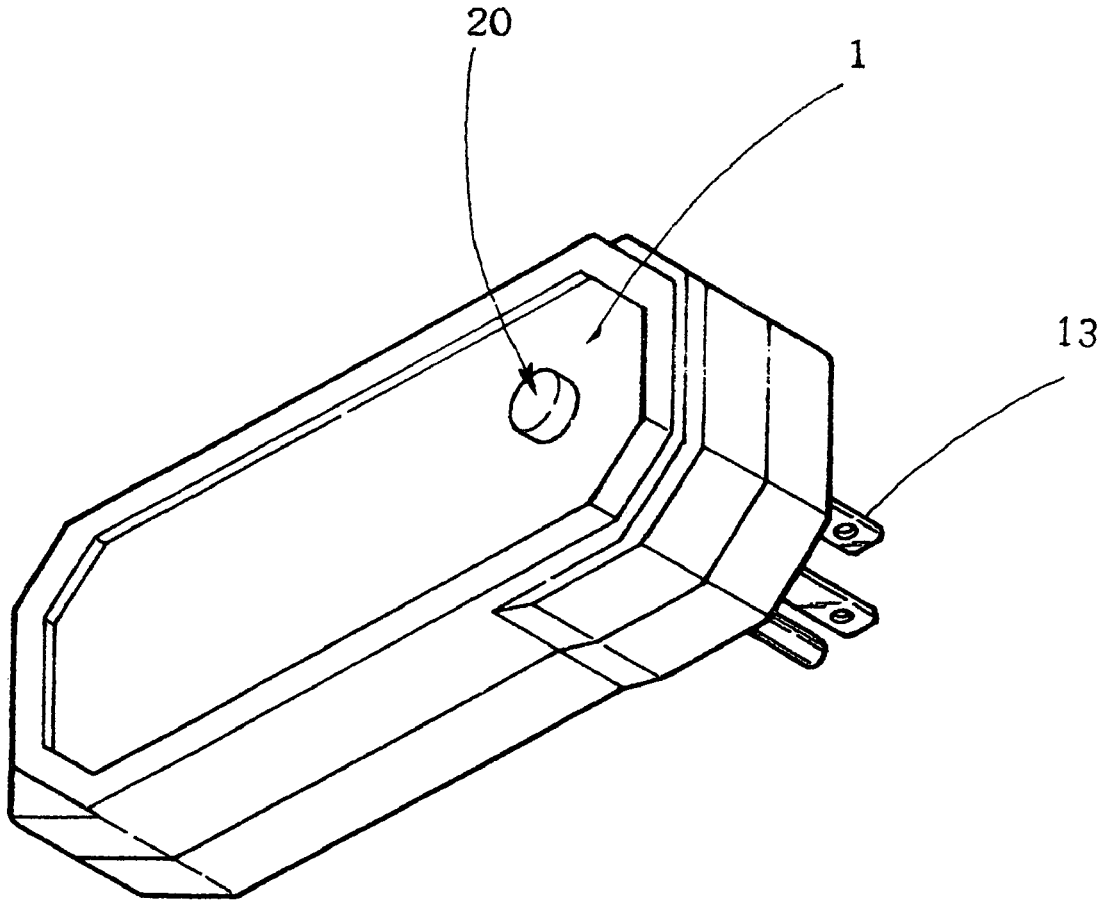
FIG. 1 is a perspective view of a plug in accordance with the preferred embodiment of the present invention.

Referring to the drawings and initially to FIG. 1, a spark leakage shutoff protective device 20 is mounted in a plug 1 to shut the electric power of the plug 1 when spark leakage occurs so as to provide a protective effect to the plug 1. The plug 1 has at least two legs 13.

Figure 2:
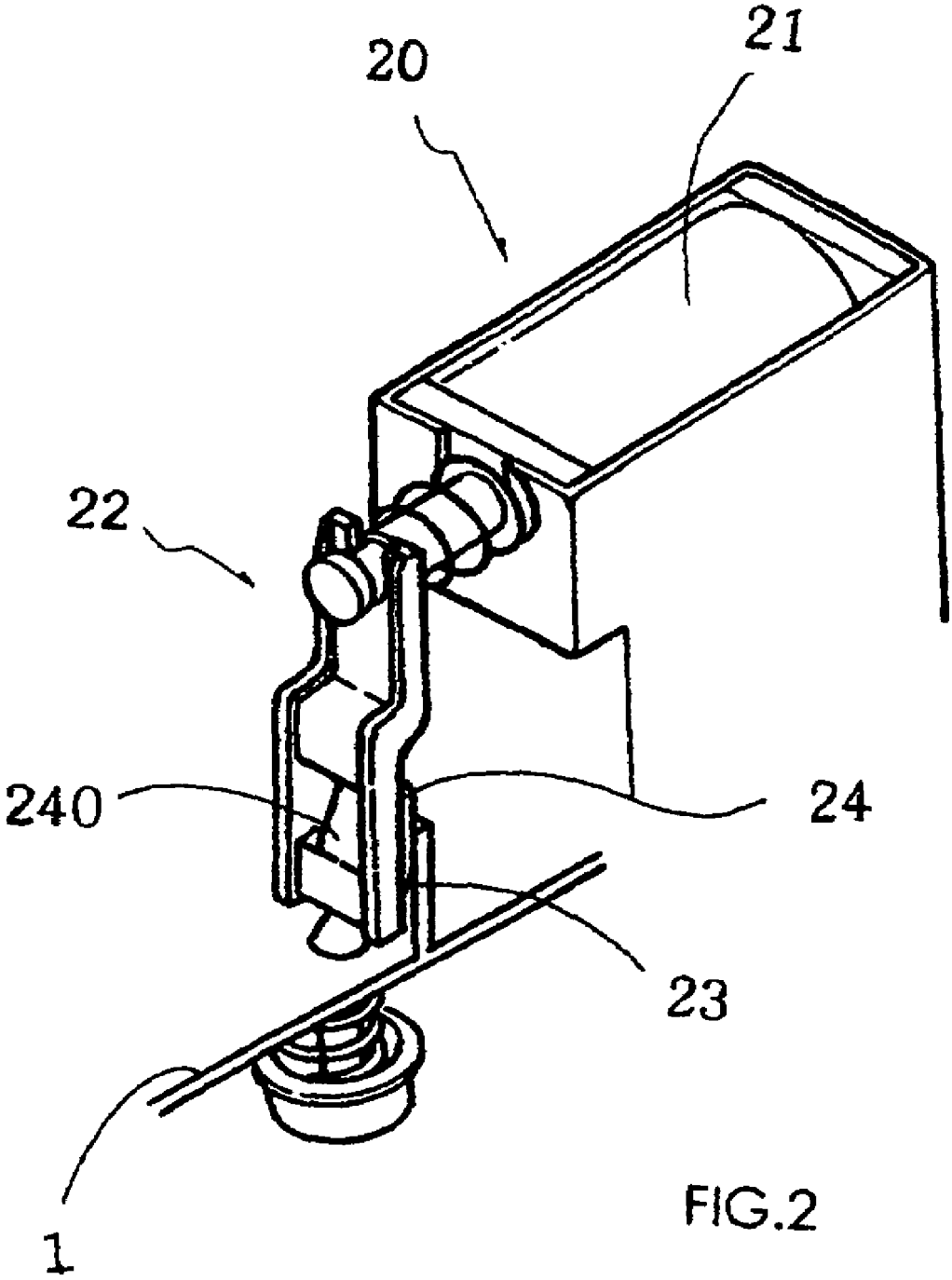
FIG. 2 is a perspective view of a spark leakage shutoff protective device for the plug in accordance with the preferred embodiment of the present invention.
Figure 3:
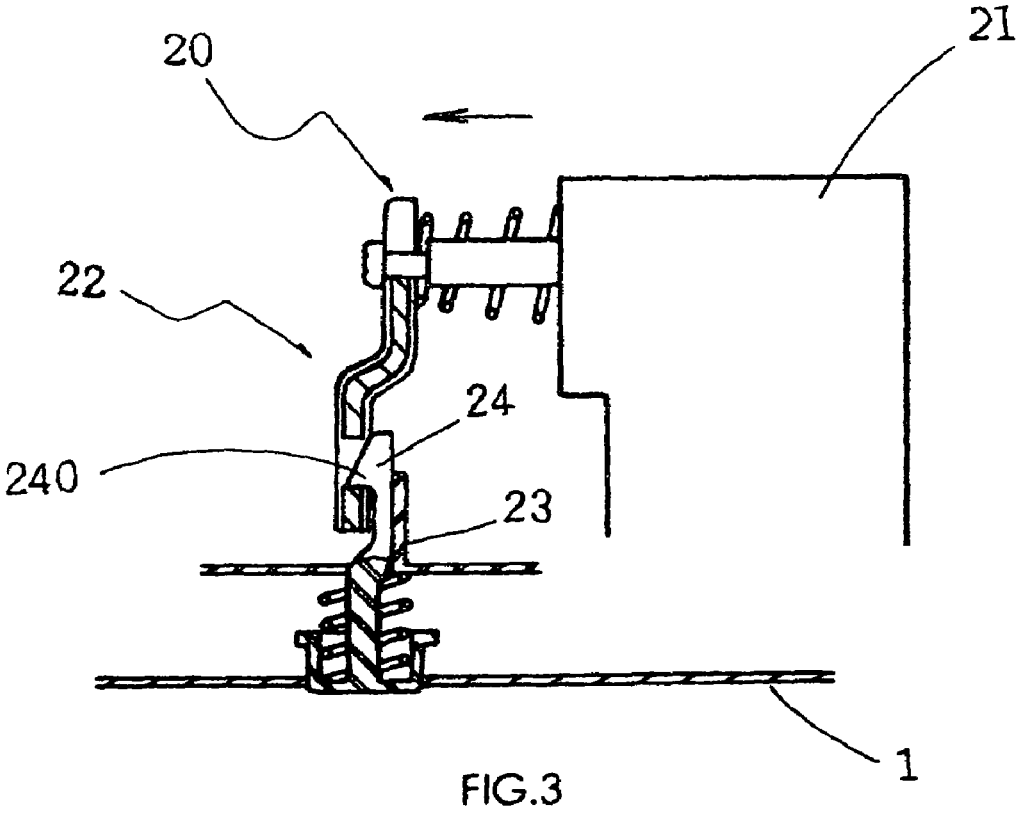
FIG. 3 is a plan cross-sectional view of the spark leakage shutoff protective device as shown in FIG. 2.
Figure 4:
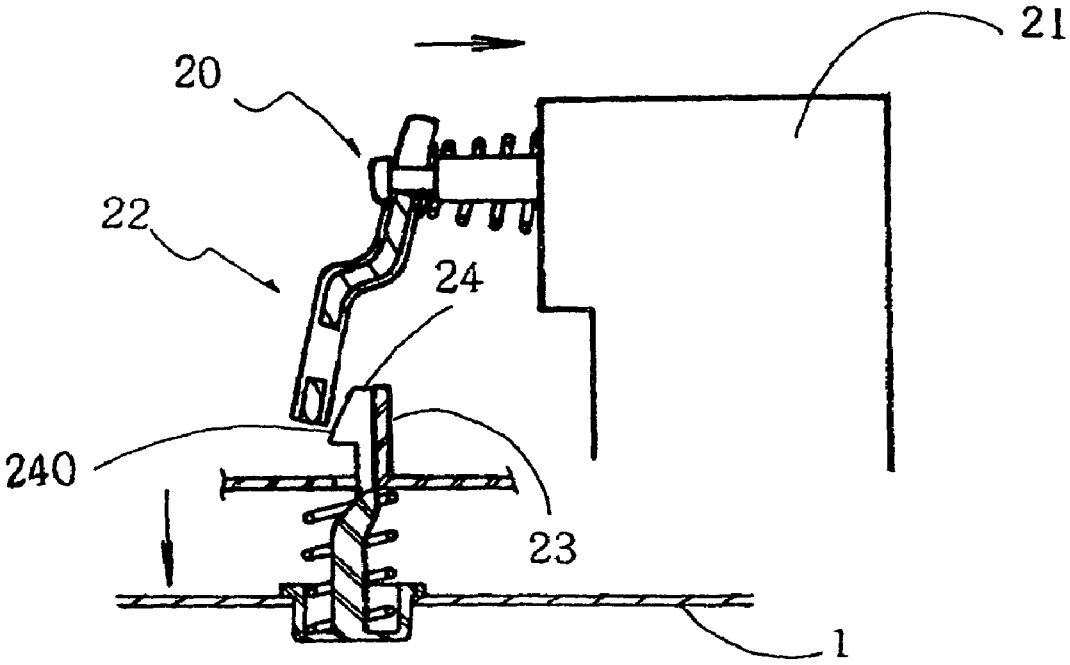
FIG. 4 is a schematic operational view of the spark leakage shutoff protective device as shown in FIG. 3.
Figure 5:
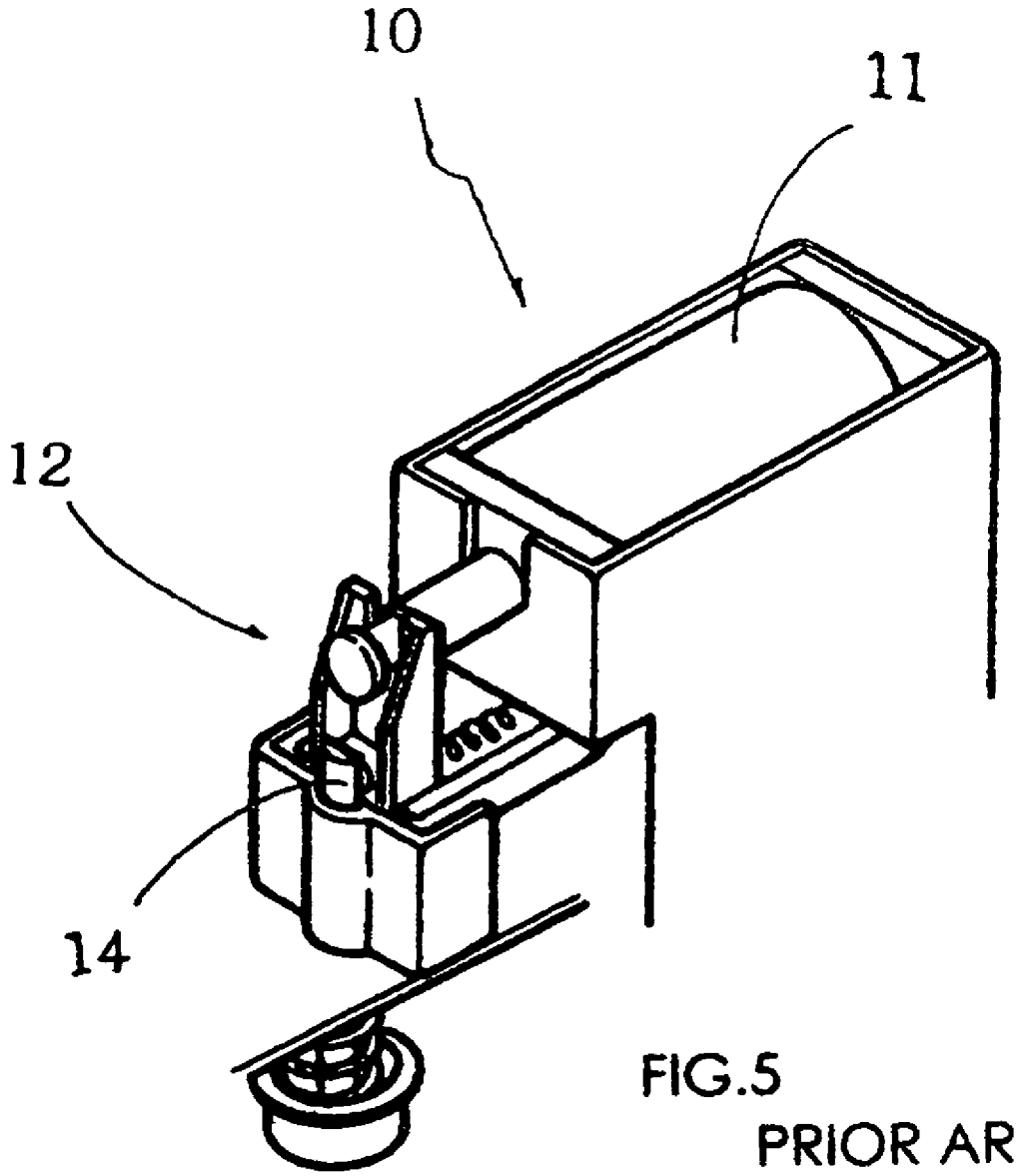
FIG.5 PRIOR ART
FIG. 5 is a perspective view of a conventional spark leakage shutoff protective device for a plug in accordance with the prior art.
Figure 6:
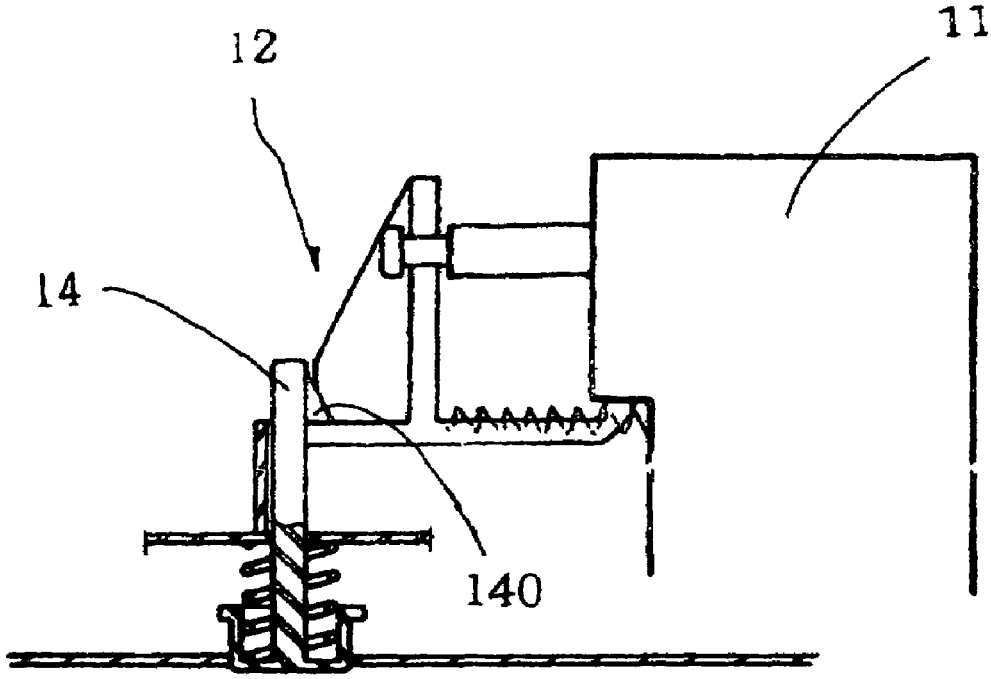
FIG.6 PRIOR ART
FIG. 6 is a plan cross-sectional view of the conventional spark leakage shutoff protective device as shown in FIG. 5.
Figure 7:
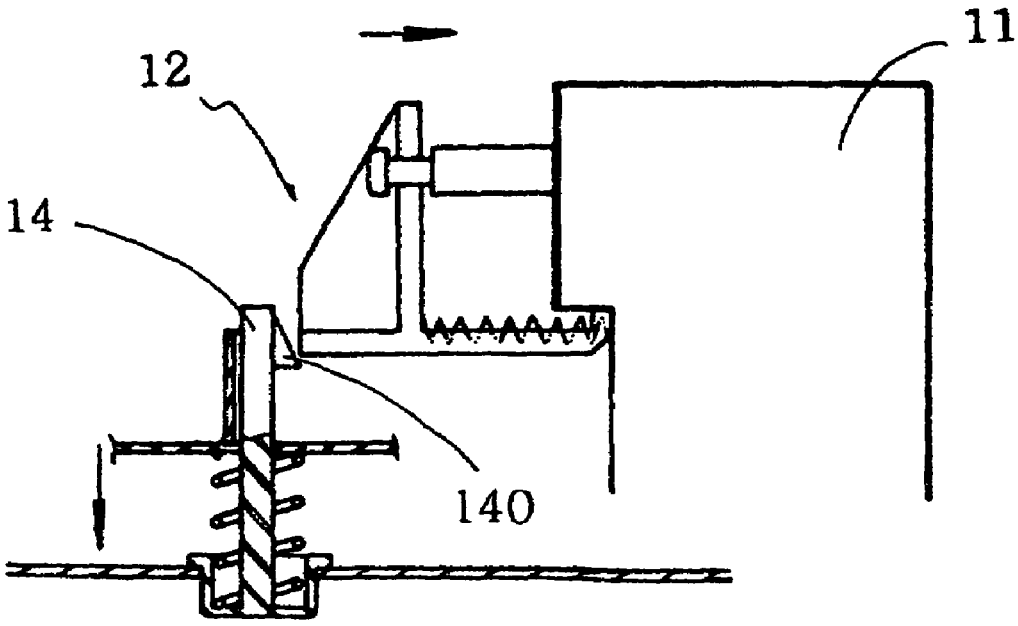
FIG.7 PRIOR ART
FIG. 7 is a schematic operational view of the conventional spark leakage shutoff protective device as shown in FIG. 6.

Referring to FIGS. 2 and 3, the spark leakage shutoff protective device 20 in accordance with the preferred embodiment of the present invention comprises an upright flexible snapping lever 24 made of plastic material mounted on the plug 1 and having a distal end formed with a snapping hook 240, a leakage detection electromagnetic valve 21 mounted on the plug 1 and spaced from the snapping lever 24, and a restoring member 22 pivotally mounted in the plug 1 and having a first end detachably mounted on the snapping hook 240 of the snapping lever 24 and a second end driven by the leakage detection electromagnetic valve 21 to move the restoring member 22 so that the restoring member 22 is movable between a first position as shown in FIG. 3 where the first end of the restoring member 22 is snapped onto the snapping hook 240 of the snapping lever 24 and a second position as shown in FIG. 4 where the first end of the restoring member 22 is detached from the snapping hook 240 of the snapping lever 24.

In operation, when the leakage detection electromagnetic valve 21 detects that the spark leakage occurs, the second end of the restoring member 22 is driven by the leakage detection electromagnetic valve 21 to move the restoring member 22 so that the first end of the restoring member 22 is detached from the snapping hook 240 of the snapping lever 24 as shown in FIG. 4, to shut the electric power of the plug 1 so as to provide a protective effect to the plug 1.

The snapping lever 24 is located between the restoring member 22 and the leakage detection electromagnetic valve 21 and has an outer side rested on an inner side of the restoring member 22. Thus, when the restoring member 22 is driven by the leakage detection electromagnetic valve 21, the restoring member 22 is movable outwardly relative to the snapping lever 24, so that the first end of the restoring member 22 is movable outwardly and detachable from the snapping hook 240 of the snapping lever 24. The snapping hook 240 of the snapping lever 24 is formed on the outer side of the snapping lever 24. The snapping hook 240 of the snapping lever 24 has a tapered shape and is arranged from an inside toward an outside thereof. The snapping hook 240 of the snapping lever 24 is extended from an inner side toward the outer side of the snapping lever 24. The snapping hook 240 of the snapping lever 24 has a thickness gradually increased from an upper end toward a lower end of the snapping hook 240.

In the preferred embodiment of the present invention, the spark leakage shutoff protective device 20 further comprises an upright support wall 23 mounted on the plug 1 and rested on the inner side of the snapping lever 24 to support the snapping lever 24. Thus, the snapping lever 24 is located between the restoring member 22 and the support wall 23.

Accordingly, the snapping lever 24 is hidden in the restoring member 22 to reduce the volume of the spark leakage shutoff protective device 20 so that the spark leakage shutoff protective device 20 occupies a smaller space in the plug 1. In addition, the snapping lever 24 is supported by the support wall 23, so that the snapping lever 24 is not easily deformed or worn out during a long-term utilization, thereby enhancing the lifetime of the snapping lever 24. Further, the snapping lever 24 is hidden in the restoring member 22 so that the snapping lever 24 is spaced from the legs 13 of the plug 1 to prevent the snapping lever 24 from being deformed or worn out due to a higher temperature of the legs 13 of the plug 1, thereby enhancing the lifetime of the snapping lever 24.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A spark leakage shutoff protective device, comprising:

an upright flexible snapping lever having a distal end formed with a snapping hook;

a leakage detection electromagnetic valve spaced from the snapping lever;

a restoring member having a first end detachably mounted on the snapping hook of the snapping lever and a second end driven by the leakage detection electromagnetic valve to move the restoring member; wherein:

the snapping lever is located between the restoring member and the leakage detection electromagnetic valve.

2. The spark leakage shutoff protective device in accordance with claim 1, further comprising an upright support wall rested on an inner side of the snapping lever to support the snapping lever.

3. The spark leakage shutoff protective device in accordance with claim 2, wherein the snapping lever is located between the restoring member and the support wall.

4. The spark leakage shutoff protective device in accordance with claim 1, wherein the snapping lever is hidden in the restoring member.

5. The spark leakage shutoff protective device in accordance with claim 1, wherein the second end of the restoring member is driven by the leakage detection electromagnetic valve to move the restoring member so that the first end of the restoring member is detached from the snapping hook of the snapping lever.

6. The spark leakage shutoff protective device in accordance with claim 1, wherein the snapping lever has an outer side rested on an inner side of the restoring member.

7. The spark leakage shutoff protective device in accordance with claim 1, wherein when the restoring member is driven by the leakage detection electromagnetic valve, the restoring member is movable outwardly relative to the snapping lever, so that the first end of the restoring member is movable outwardly and detachable from the snapping hook of the snapping lever.

8. The spark leakage shutoff protective device in accordance with claim 6, wherein the snapping hook of the snapping lever is formed on the outer side of the snapping lever.

9. The spark leakage shutoff protective device in accordance with claim 1, wherein the snapping hook of the snapping lever has a tapered shape and is arranged from an inside toward an outside thereof.

10. The spark leakage shutoff protective device in accordance with claim 1, wherein the snapping hook of the snapping lever is extended from an inner side toward the outer side of the snapping lever.

11. The spark leakage shutoff protective device in accordance with claim 1, wherein the snapping hook of the snapping lever has a thickness gradually increased from an upper end toward a lower end of the snapping hook.

12. The spark leakage shutoff protective device in accordance with claim 1, wherein the restoring member is movable between a first position where the first end of the restoring member is snapped onto the snapping hook of the snapping lever and a second position where the first end of the restoring member is detached from the snapping hook of the snapping lever.

* * * * *